US007047846B1

(12) United States Patent
Hu

(10) Patent No.: US 7,047,846 B1
(45) Date of Patent: May 23, 2006

(54) HAND TOOL

(75) Inventor: Hung-Ming Hu, Tainan Hsien (TW)

(73) Assignee: Gong Fong Enterprise Co., Ltd., Tainan Hsien (TW)

( * ) Notice: Subject to any disclaimer, the term of this patent is extended or adjusted under 35 U.S.C. 154(b) by 0 days.

(21) Appl. No.: 11/146,039

(22) Filed: Jun. 7, 2005

(51) Int. Cl.
*B25B 23/16* (2006.01)

(52) U.S. Cl. ..... 81/177.7; 81/177.8; 81/177.4; 81/490; 81/438; 16/111.1; 16/900

(58) Field of Classification Search ..... 81/177.7, 81/177.8, 177.9, 177.4, 490, 437–439; 16/111.1, 16/438, 900; B25B 23/16
See application file for complete search history.

(56) References Cited

U.S. PATENT DOCUMENTS

| | | | | |
|---|---|---|---|---|
| 4,227,430 | A * | 10/1980 | Jansson et al. | 81/177.4 |
| 4,825,734 | A * | 5/1989 | Schwalbe et al. | 81/177.9 |
| 6,386,075 | B1 * | 5/2002 | Shiao | 81/177.8 |
| 6,520,053 | B1 * | 2/2003 | Liao | 81/177.9 |
| 6,877,186 | B1 * | 4/2005 | Shiao | 81/177.4 |

* cited by examiner

*Primary Examiner*—Hadi Shakeri
(74) *Attorney, Agent, or Firm*—Rosenberg, Klein & Lee

(57) ABSTRACT

A hand tool includes a handle having at its one end provided with a chamber containing a through hole to accommodate a locking unit and at another end disposed with pivoting sections to pivot a stem for the stem to be bent into a specific angle in relation with the handle; a holder being secured in position in the chamber of the handle; a push rod in the holder pushing against the locking unit for a locking bit to be restricted in one of internal teeth of a gear of the stem to hold the hand tool in position to facilitate its use.

6 Claims, 7 Drawing Sheets

HAND TOOL

BACKGROUND OF THE INVENTION (a) Field of the Invention

The present invention relates to a hand tool, and more particularly, to a handle pivoted with a stem to be bent into a specific angle and a holder pushing against a locking unit to secure the stem in position to cope with a particular job at the specific angle.

(b) Description of the Prior Art

Any hand tool provided with a screwdriver tip is usually adapted with a handle on one end and the tip on the other end with the bit either fixed or retractable to exchange with another bit of different specification depending on the particular type of the screw. However, the handle and the bit are located on the same straight line to prevent bending into any other angle. When the job site is prevented from easy access due to certain barriers and those barriers cannot be removed, the use of the hand tool can be easily frustrated or failed despite all the efforts and time.

Accordingly, the prior art as illustrated in FIG. 7 of the accompanying drawings was introduced to provide a solution. The prior art comprises a handle (A) having its one end pivoted to a connection rod (B) by means of a shank (A1). Another end of the connection rod (B) is provided with a tool shank (B1) for the handle (A1) to be fixed to a screwdriver bit. A locking bead (B2) pushed by a spring (B3) is provided at where the connection rod (B) is pivoted to the handle (A) while a recess (A2) is provided to the handle (A) in relation to where the locking bead (B2) is located.

In use, the locking bead (B2) is secured inside the recess (A2) when both the handle (A) and the connection rod (B) are located on the same straight line (0°). Accordingly, the connection rod (B) is adapted with the screwdriver bit to tighten or loosen up a screw. When another angle of the use is desired, the connection rod (B) is turned for the recess (A2) to stay clear from the limitation by the locking bead (B2), and for the locking bead (B2) to hold against the sidewall in the front end of the handle (A) for both the handle (A) and the connection rod (B) to be at right angle to each other and secured in position. However, the prior art has only two options of the working angles, i.e., 0° and 90° to be defined by both the connection rod (B) and the handle (A). The prior art is rendered useless when the job site involves any angle other than 0° and 90°. Furthermore, since both the connection rod (B) and the handle (A) are held in position only by relying upon the locking bead (B2) pushed by the spring of the spring (B3), the locking bead (B2) is vulnerable to spring fatigue thus to lose its locking purpose.

SUMMARY OF THE INVENTION

The primary purpose of the present invention is to provide a hand tool to correct those shortcomings found with the prior art. To achieve the purpose, the present invention comprises a handle having at its one end provided with a chamber containing a through hole to accommodate a locking unit and at another end provided with pivoting sections to pivot a stem for the stem to be bent into a specific angle in relation with the handle; a holder is secured in position in the chamber of the handle; and a push rod in the holder pushes against the locking unit for a locking bit to be restricted in one of internal teeth of a gear of the stem to hold the hand tool in position to facilitate its use.

The present invention does provide the following advantages:

1. The locking bit of the locking unit is movably locked into the internal tooth of the gear of the stem to secure the present invention in position at a selected angle to facilitate tightening or loosening up a fastener.
2. A plurality of troughs disposed in the holder accommodate several screwdriver bits of various sizes and forms to be stored in the chamber of the handle for easy carrying along without consuming additional space and preventing from being lost.

DETAILED DESCRIPTION OF THE PREFERRED EMBODIMENT

Figure 1:
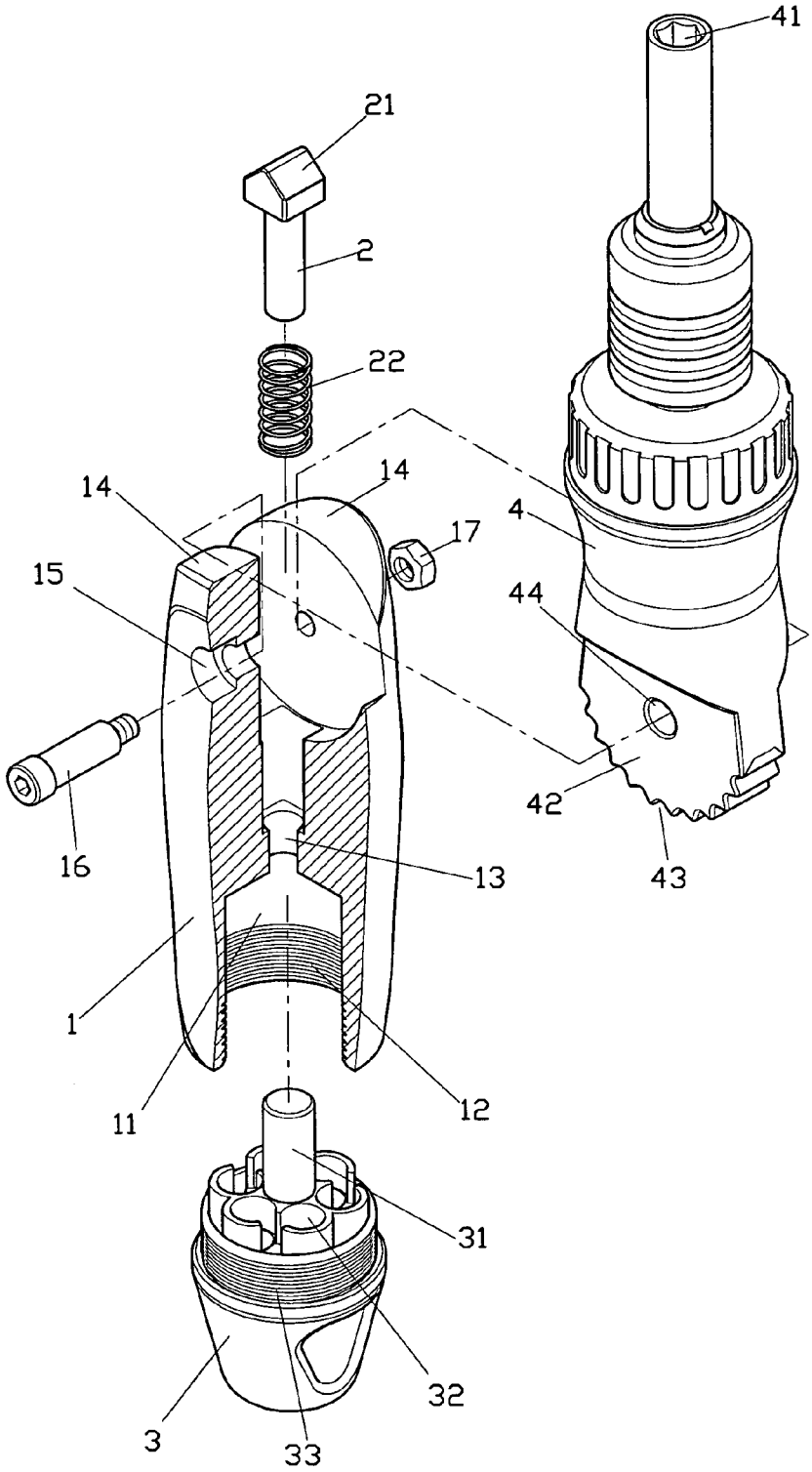
FIG. 1 is an exploded view of a preferred embodiment of the present invention.

Referring to FIG. 1, a preferred embodiment of the present invention comprises a handle (1), a locking unit (2), a holder (3) and a stem (4).

The holder handle (1) is provided with a chamber (11) at on end and two relative pivoting sections (14) protruding from the other end. The chamber (11) is provided with a thread (12) on the inner circumference of an opening, and a through hole (13) penetrating through the handle (1) is provided to the chamber (11). The pivoting sections (14) are provided with pivoting holes (15) to receive insertion of a pivoting element (16), and the pivoting element (16) is then secured with a nut (17).

The locking unit (2) is placed in the through hole (13) of the handle (1). One end of the locking unit (2) is provided with a locking bit (21) and a spring (22) is inserted onto the locking unit (2).

The holder (3) is screwed into the chamber (11) of the handle (1). A push rod (31) protrudes from the holder (3) and a plurality of troughs surrounding the push rod (31) is provided in the holder (3). The holder (3) is provided with a thread (33) on the outer circumference of the holder (3).

The stem (4) is pivotally connected to the pivoting sections (14) of the handle (1). One end of the stem (4) is provided with a shank (41) and the other end of the stem (4) is provided with a gear (42) having a plurality of internal teeth (43) on the perimeter of the gear (42). The gear (42) is provided with a pivoting hole (44) penetrating through the gear (42).

Figure 2:
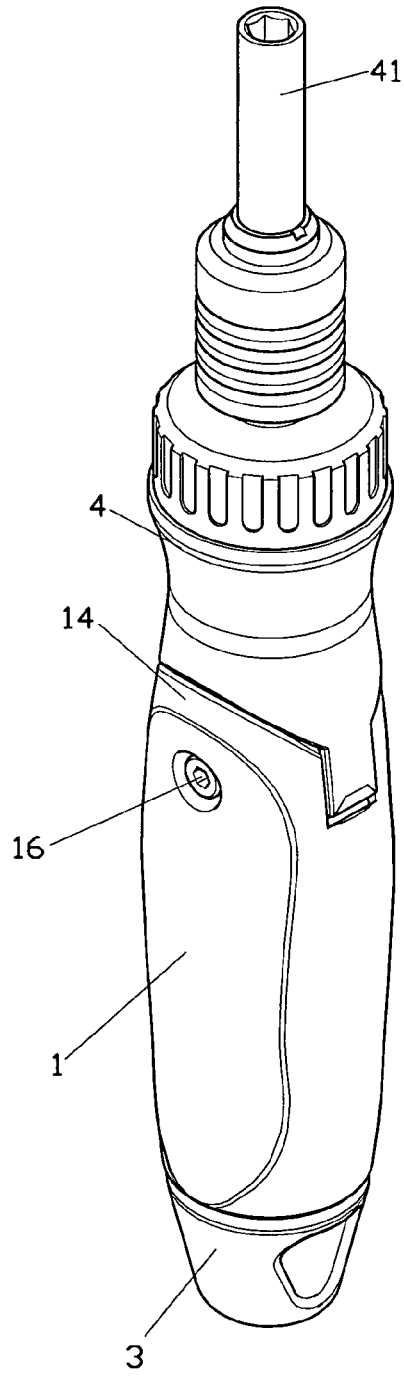
FIG. 2 is a perspective view of the preferred embodiment of the present invention.
Figure 3:
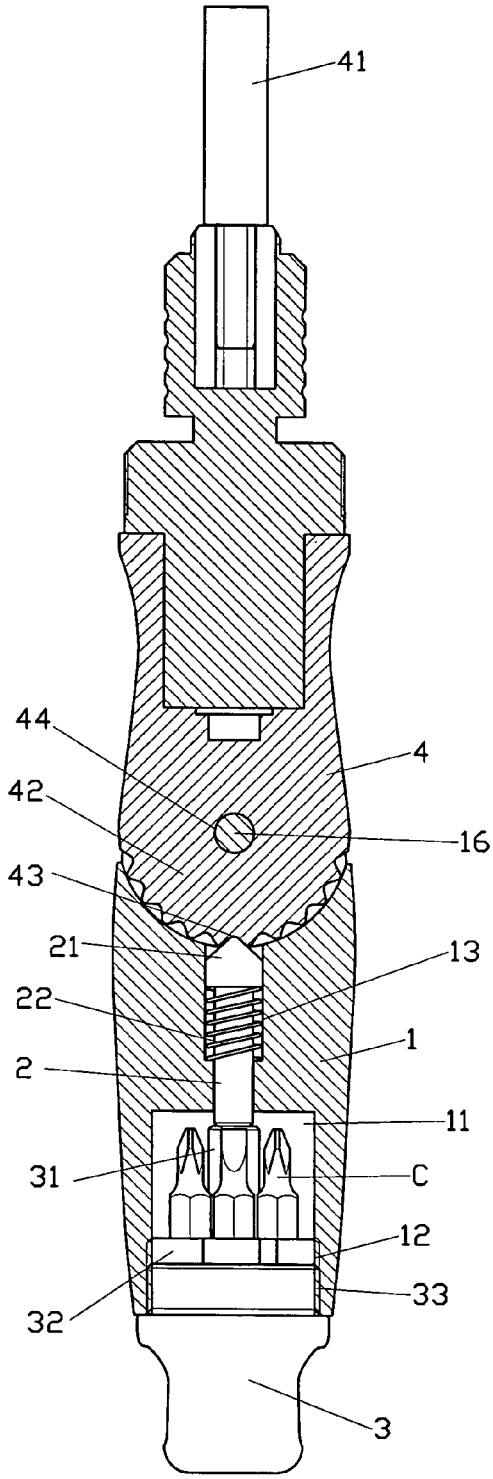
FIG. 3 is a sectional view of the preferred embodiment of the present invention as assembled.

When assembled as illustrated in FIGS. 2 and 3, the spring (22) is first inserted onto the locking unit (2). The locking unit (2) and the spring (22) are then placed into the trough hole (13) of the handle (1). The gear (42) of the stem (4) is then placed between the pivoting sections (14) of the handle (1) with the pivoting holes (44) and (15) aligned to each other to receive insertion of the pivoting element (16). The pivoting element (16) is then secured by means of the nut (17). Accordingly, the locking bit (21) of the locking unit (2) engages into one of the internal teeth (43) of the stem (4). A number of screwdriver bits (C) of different sizes and forms are stored in the troughs (32) and secured in the handle (1) by having the thread (33) of the holder (3) engaged with the thread (12) in the chamber (11) for the push rod (31) of the holder (3) to push against the locking unit (2) thus to constantly restrict the locking bit (21) in the internal tooth (43) of the gear (42).

Figure 4:
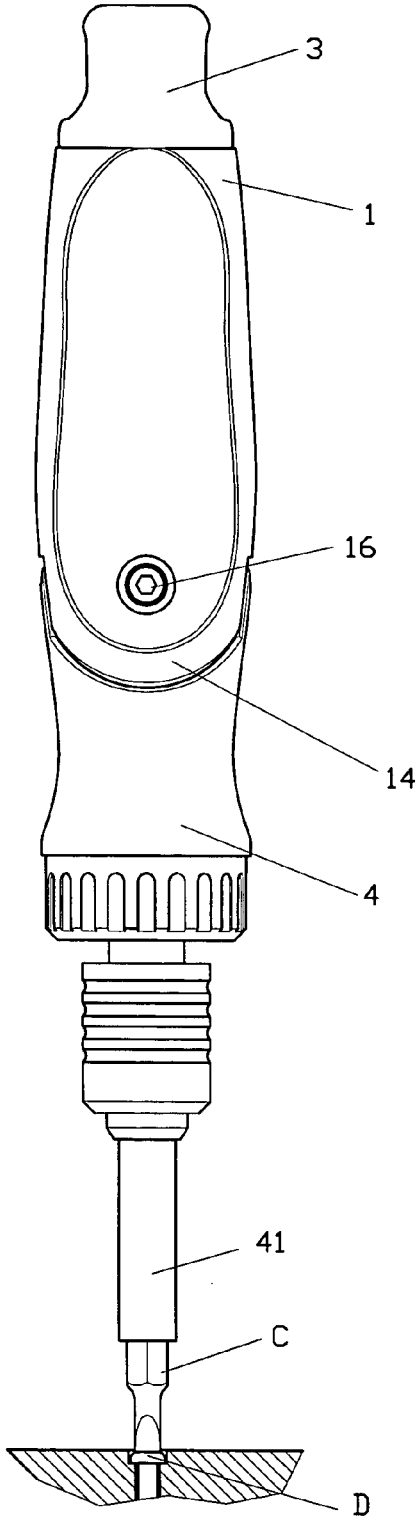
FIG. 4 is a schematic view showing the operation of the preferred embodiment of the present invention.

When in use as illustrated in FIG. 4, the shank (41) of the stem (4) is connected with a desired screwdriver bit (C) for tightening or loosening up a screw (D) or other fasteners by rotating the handle (1).

Figure 5:
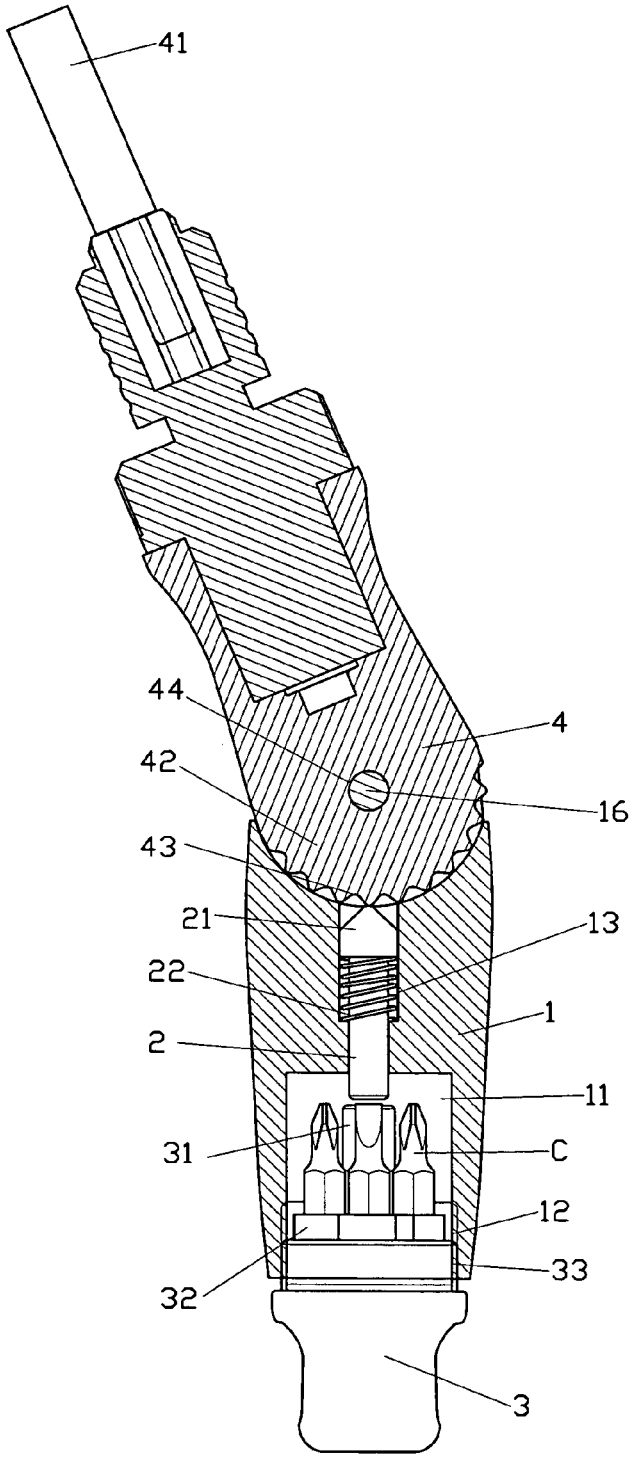
FIG. 5 is a schematic view showing that a locking bit is retreated from an internal tooth in the preferred embodiment of the present invention.
Figure 6:
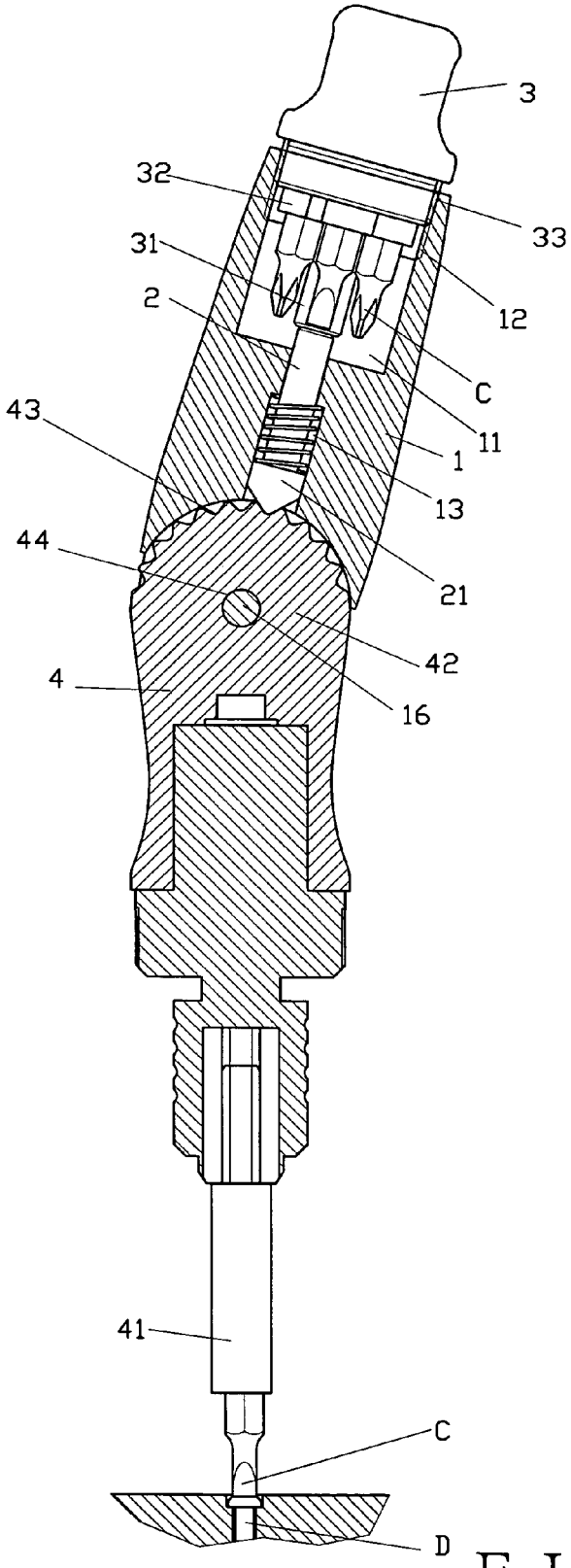
FIG. 6 is a schematic view showing that a stem of the present invention is bent into another angle.
Figure 7:
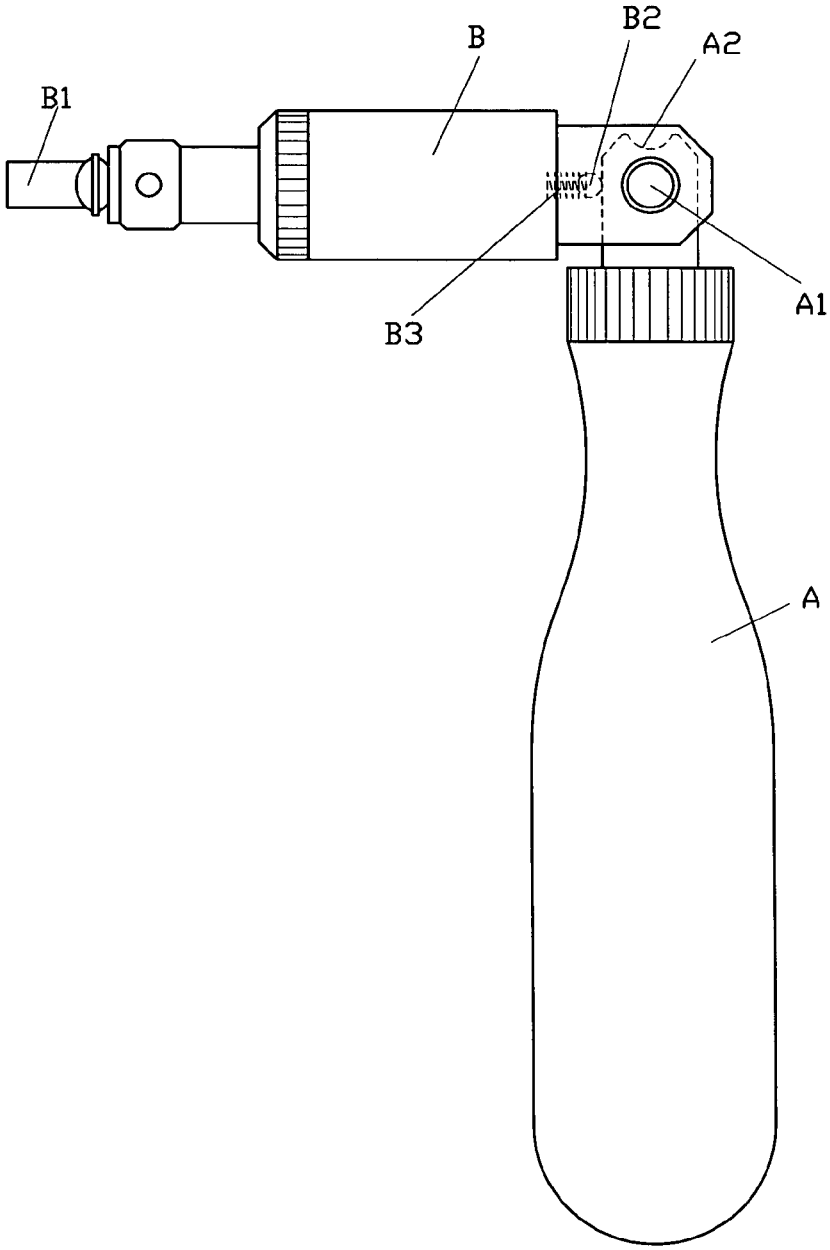
F I G . 7 (PRIOR ART)
FIG. 7 is a side view of a prior art.

If a specific angle is needed to access to the screw (D) as illustrated in FIG. 5, the holder (3) is loosened up to release the push rod (31) of the holder (3) from pushing against the locking unit (2). In turn, the locking bit (21) of the locking unit (2) exits from the internal tooth (43) of the gear (42) of the stem (4) to swivel the stem (4) at the pivoting sections (14) of the handle (1). When the gear (42) is turned, it intermittently pushes against the locking bit (21) to compress the spring (22) in executing an intermittent locking process so to permit both the handle (1) and the stem (4) to be turned to an optimal angle before tightening up the holder (3) to be secured in the chamber (11) of the handle (1). Accordingly, the locking bit (21) is once again secured in the internal tooth (43) of the gear (42) for both the stem (4) and the handle (1) to be fixed at the optimal angle as illustrated in FIG. 6 to go ahead with the job of tightening or loosening up the screw (D).

I claim:

1. A hand tool comprising a handle and a stem, one end of said handle being provided with a chamber and another end of said handle being provided with pivoting sections; said stem being pivotally connected to said pivoting sections of said handle;

one end of said stem being provided with a shank; and characterized in that:

the hand tool further comprising a locking unit and a holder, a through hole penetrating said handle being provided in said chamber of said handle; the outer circumference of said holder and the inner circumference of an opening of said chamber being threaded; said handle and said holder engaging each other by their respective threads thereby securing said holder in said chamber of said handle;

said locking unit being placed in said through hole; one end of said locking unit being provided with a locking bit; a push rod being provided in said holder; said locking unit being pushed by said push rod; a gear being provided at another end of said stem; internal teeth being provided on the perimeter of said gear; said locking bit of said locking unit being restricted in one of said internal teeth.

2. The hand tool of claim 1, wherein said holder is provided with a plurality of troughs surrounding said push rod.

3. The hand tool of claim 1, wherein said pivoting sections of said handle are provided with pivoting holes and said stem is provided with another pivoting hole for insertion of a pivoting element fastened by means of a nut.

4. The hand tool of claim 1, wherein said locking unit comprises a spring thereon.

5. A hand tool comprising:

a handle, having at a proximal end thereof a chamber containing a longitudinal through hole and at a distal end thereof a pair of opposing pivoting sections, said pivoting sections each having formed therethrough a corresponding pivoting hole to receive a pivoting element;

a stem being received between said pivoting sections of said handle and pivotally coupled thereto by said pivoting element, a distal end of said stem having a shank coupled thereto and a proximal end thereof having formed thereon a plurality of internal teeth;

a holder being received in said chamber of said handle and longitudinally displaceable therein, said holder including a push rod protruding from a distal end thereof; and, a locking unit received in said distal end of said handle and longitudinally displaceable therein, said locking unit extending through said through hole into said chamber, said locking unit having formed on a distal end thereof a locking bit engaging said internal teeth of said stem, wherein said push rod immovably engages said locking unit when said holder is in said predetermined position so as to rigidly engage said internal teeth with said locking bit and securing said stem in a selected angular position relative to said handle thereby, said stem being movable from said angular position only if said holder is laterally displaced from said predetermined position.

6. The hand tool as recited in claim 5, wherein said holder is threadedly engaged with said chamber and laterally displaceable therein by rotation thereof.

* * * * *